US009914628B2

(12) United States Patent
Cenci et al.

(10) Patent No.: US 9,914,628 B2
(45) Date of Patent: Mar. 13, 2018

(54) UNIT FOR CARRYING OUT AN OPERATION ON A CONTAINER FILLABLE WITH A POURABLE PRODUCT

(71) Applicant: Sidel S.p.A. con SOCIO UNICO, Parma (IT)

(72) Inventors: Mattia Cenci, Parma (IT); Filippo Bandini, Parma (IT); Michele Bacchi-Palazzi, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 574 days.

(21) Appl. No.: 14/585,503

(22) Filed: Dec. 30, 2014

(65) Prior Publication Data

US 2015/0183538 A1 Jul. 2, 2015

(30) Foreign Application Priority Data

Dec. 30, 2013 (EP) ..... 13199858

(51) Int. Cl.
*B67C 3/24* (2006.01)
*B67B 3/28* (2006.01)
(Continued)

(52) U.S. Cl.
CPC ..... *B67C 3/242* (2013.01); *B67B 3/28* (2013.01); *B67C 3/246* (2013.01);
(Continued)

(58) Field of Classification Search
CPC ..... B67B 3/2033; B67B 3/28; B67B 2201/08; B67C 3/242; B67C 3/246; B67C 2003/228; B67C 2003/2694; B67C 7/0073
See application file for complete search history.

(56) References Cited

U.S. PATENT DOCUMENTS 3,580,302 A * 5/1971 Riesenberg ..... B67C 3/246 141/141
3,691,720 A * 9/1972 Anderson et al. ..... B65B 31/02 228/219
(Continued)

FOREIGN PATENT DOCUMENTS

EP 0486438 A2 * 5/1992 ..... B67C 3/242
EP 2559444 A1 2/2013
WO WO 2009/009681 1/2009

OTHER PUBLICATIONS

European Search Report in EP 13199858, dated May 12, 2014 (6 pages).

*Primary Examiner* — Stephen F Gerrity
(74) *Attorney, Agent, or Firm* — Finnegan, Henderson, Farabow, Garrett & Dunner LLP

(57) ABSTRACT

A unit for carrying out an operation on a container fillable with a pourable product is disclosed. The unit comprises: a first area; a second area; at least one operative head, which is adapted to carry out the operation; at least one gripping device for gripping the container and which is movable between a rest position, in which the at least one gripping device receives or discharges the container; and an operative position, in which the at least one gripping device sets the container in a position in which the container undergoes the operation. The unit further comprises: a movable element, which is operatively connected to the at least one gripping device for moving the at least one gripping device between the rest position and the operative position, and which comprises a portion movable between the first area and the second area; and a bellow.

20 Claims, 5 Drawing Sheets

(51) Int. Cl.
*B67C 3/22* (2006.01)
*B67C 3/26* (2006.01)

(52) U.S. Cl.
CPC ..... *B67B 2201/08* (2013.01); *B67C 2003/228* (2013.01); *B67C 2003/2694* (2013.01)

(56) References Cited

U.S. PATENT DOCUMENTS 5,301,725 A * 4/1994 Meinzinger ..... B67C 3/242 141/312
5,586,585 A * 12/1996 Bonora et al. .... H01L 21/67772 141/1
6,026,867 A * 2/2000 Klarl ..... B67C 7/0073 141/150
8,083,854 B2 * 12/2011 Cirette ..... F04B 53/12 118/715
8,869,496 B2 * 10/2014 Laumer et al. ..... B67C 7/0073 53/173
2004/0068957 A1 * 4/2004 Edwards et al. ..... B65B 7/28 53/268
2008/0078144 A1 * 4/2008 Cirio ..... B67B 3/2033 53/359
2009/0095370 A1 * 4/2009 Krulitsch ..... B67C 3/242 141/6
2010/0037984 A1 2/2010 Hiroya et al.
2010/0126116 A1 * 5/2010 Buchhauser et al. . B67B 3/2033 53/287
2011/0023996 A1 2/2011 Laumer et al.
2011/0197993 A1 * 8/2011 Krulitsch ..... B67C 3/2637 141/192
2011/0232233 A1 * 9/2011 Klarl et al. ..... B67C 7/0073 53/426
2012/0210673 A1 * 8/2012 Schoenfelder ..... B67B 3/2033 53/111 R
2013/0216430 A1 * 8/2013 Knott et al. ..... B65B 55/08 422/22
2015/0375980 A1 * 12/2015 Naaber et al. ..... B67B 3/2033 53/317

* cited by examiner

UNIT FOR CARRYING OUT AN OPERATION ON A CONTAINER FILLABLE WITH A POURABLE PRODUCT

CROSS-REFERENCE TO RELATED APPLICATIONS

This application claims the benefit of priority of European Patent Application No. 13199858.5, filed Dec. 30, 2013, which is incorporated herein by reference.

The present invention relates to a unit for carrying out an operation on a container fillable with a pourable product.

Preferably, the present invention relates to a filling unit for filling the container, in particular with an aseptic pourable food product, e.g. with a delicate product which cannot be added with a substantial amount of preservative substances.

BACKGROUND OF THE INVENTION

A filling unit for filling containers with an aseptic pourable food product is known from US-A-2011/0023996.

In greater detail, the filling unit substantially comprises:

- a carousel conveyor rotating about a rotation axis;
- a tank containing the pourable food product; and
- a plurality of filling devices supported by the carousel conveyor in a position radially external with respect to the rotation axis of the carousel conveyor.

In greater detail, the carousel is provided with a plurality of gripping devices for gripping the neck of respective containers and moving the containers towards and away from the respective filling device.

Still more precisely, each gripping device comprises a pair of jaws which can be moved between an open configuration in which they receive or release the neck of the container, and a closed configuration in which they firmly grip the container.

Furthermore, when the jaws are arranged in the closed configuration, the gripping device can be moved along a vertical direction between:

- a rest position, in which a mouth of the container is spaced from a pouring opening of the filling device; and
- an operative position, in which the container is closer to the pouring opening and undergoes the filling operation.

The filling unit also comprises a plurality of lifting devices which are operatively connected with respective gripping devices, so as to cause their movement along the vertical direction.

The known filling unit also comprises:

- an aseptic area, in which aseptic conditions are preserved and where containers are filled with the pourable product;
- a non-aseptic area; and
- a wall, which divides the aseptic area from the non-aseptic area.

The gripping devices and the containers are arranged in the aseptic area.

Each lifting device has a servomotor arranged in the non-aseptic area and a rod which is driven by the servomotor and is operatively connected to the relative gripping member.

In particular, the rod has a portion, which passes through the wall. There is therefore the risk that the portion of the rod drives non-sterile air inside the aseptic area, thus contaminating the latter.

In order to contain that risk of contamination, each lifting device comprises a bellow which is interposed between a fixed part of the lifting device and an end of the rod.

The end of the rod is arranged in the aseptic area and the bellow seals the portion of the rod arranged in the aseptic-area.

Still more precisely, each bellow is arranged between the relative gripping device and the pouring opening relative filling device.

Furthermore, each bellow is arranged over the mouth of the respective container.

There is therefore the risk that, due the inevitable leakage of the bellows, the non-sterile air can reach the mouths of the containers when the respective gripping devices are in the lowered position, and contaminate either the containers or the food product contained in the containers, thus affecting the asepticity of the filling operation.

A need is felt within the industry to improve as far as possible the asepticity of the pourable product filled in the containers.

SUMMARY OF THE INVENTION

It is an object of the present invention to provide a unit for carrying out an operation on a container fillable with pourable product, which allows to easily and cost-effectively meet the above-identified requirement.

The aforementioned object is achieved by the present invention as it relates to a unit for carrying out an operation on a container fillable with a pourable product.

BRIEF DESCRIPTION OF THE DRAWINGS

One preferred embodiment is hereinafter disclosed for a better understanding of the present invention, by way of non-limitative example and with reference to the accompanying drawings, in which.

DETAILED DESCRIPTION OF THE INVENTION

Figure 1:
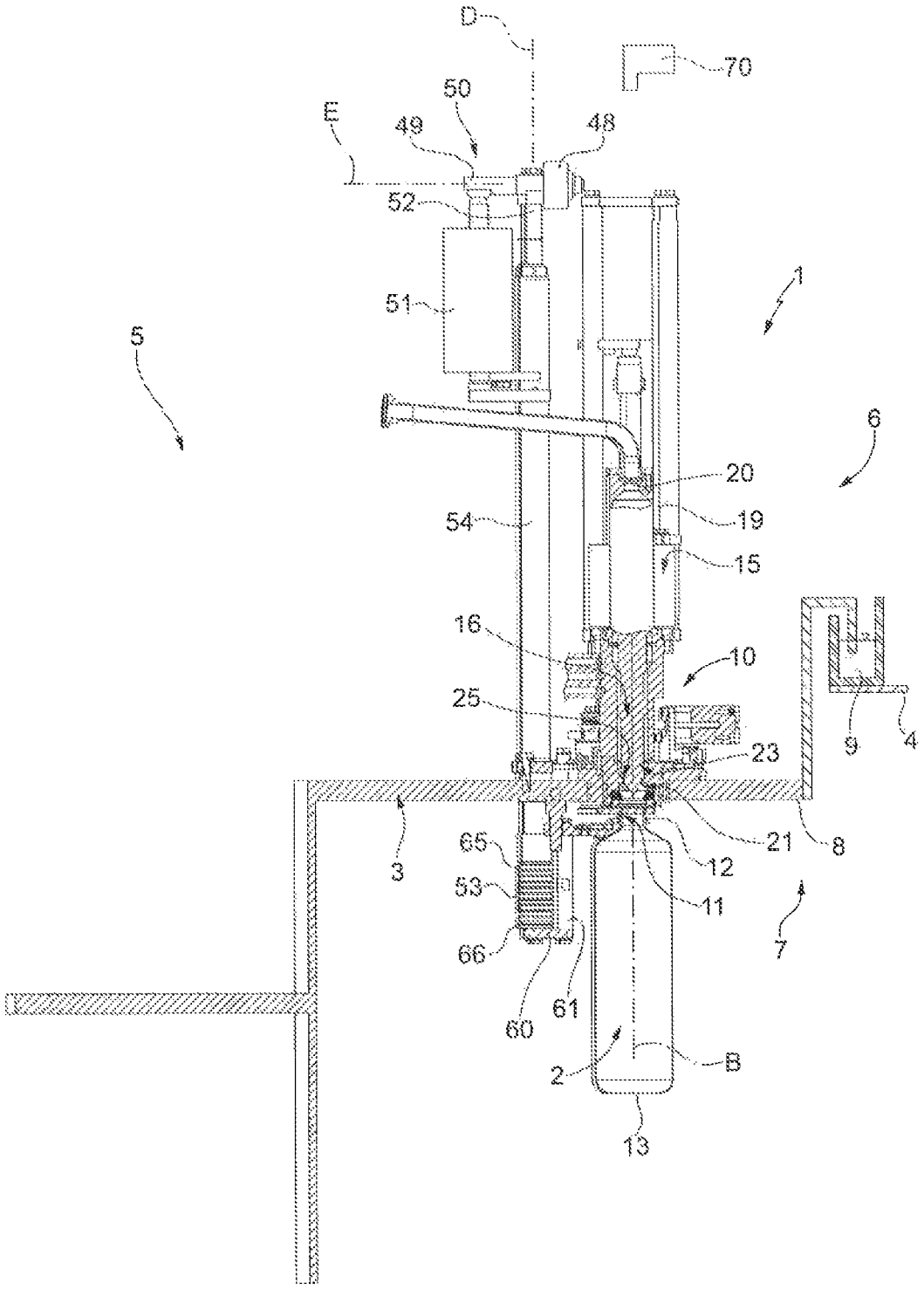
FIG. 1 shows a schematic view of a filling unit according to the present invention, with parts removed for clarity.

With reference to FIGS. 1 to 5, numeral 1 indicates a filling unit for filling containers 2 with a pourable product.

Preferably, filling unit 1 is adapted to fill containers 2 under aseptic conditions with a pourable product which does not contain preservative substances.

With reference to FIGS. 1 to 5, numeral 5 indicates a machine comprising filling unit 1 and a not-shown capping unit for applying a plurality of caps onto respective containers 2. In particular, the capping unit is downstream of filling unit 1.

In greater detail, filling unit 1 substantially comprises (FIGS. 1 and 5):

- a carousel 3 rotating about an axis A, which is vertical in the case shown, along an arc-shaped path P extending from an input station I to an output station O;
- a frame 4, with respect to which carousel 3 is rotatable about axis A; and a plurality of filling devices 10 adapted to fill respective containers 2 with the pourable food product and supported by a peripheral edge external to axis A of carousel 3.

Carousel 3 also includes a tank (not-shown) common to all filling devices 10 and which is filled with the pourable food product.

Each container 2 comprises (FIG. 1):

a mouth 11 adapted to allow the filling of container 2 by means of filling unit 1 and the following pouring of the food product from container 2;

a neck 12 arranged immediately below mouth 11; and a bottom wall 13 opposite to mouth 11.

Unit 1 further comprises:

a first area, a non-aseptic area 6 in the embodiment shown;

a second area, an aseptic area 7 filled with sterile air in the embodiment shown; and a wall 8 which divides areas 6, 7.

Wall 8 rotates integrally with carousel 3 about axis A and is passed through by filling devices 10.

Area 6 is kept at a first value of pressure whereas area 7 is kept at a second value of pressure greater than the first value.

Unit 1 also comprises a hydraulic barrier 9 for hydraulically separating non-aseptic area 6 from aseptic area 7.

In the embodiment shown, hydraulic barrier 9 is formed by a siphon, which is stationary with respect to axis A.

Siphon is filled with a bactericide substance.

Hydraulic barrier 9 prevents the flow of non-sterile air from non aseptic area 6 and aseptic area 7 at the interface between carousel 3 and frame 4.

For simplicity, the following description will refer to only one filling device 10 and to relative container 2, as devices 10 are identical to one another.

Filling device 10 substantially comprises (FIG. 1):

a frame 15 fitted to carousel 3;

a hollow body 19 which is defined by frame 15 and which extends about an axis B parallel to and staggered from axis A;

a shutter 16 movable along axis B inside body 19; and a gripping device 17 movable along axis B towards and away filling device 10 and configured to grip neck 12 of container 2.

Body 19 comprises, in turn, proceeding along axis B:

an opening 20, which is fluidly connected with tank; and an opening 21, which is opposite to opening 20, which faces mouth 11 of container 2 and through which the food product passes during the filling of container 2.

In the embodiment shown, shutter 16 comprises:

a stem 23 which receives a force along axis B; and a plunger 25 which is arranged at an end of stem 23 arranged on the side of opening 21.

Plunger 25 is conical of axis B and comprises a conical end on the side of opening 21 shaped correspondingly to the shape of opening 21.

Shutter 16 is movable relative to body 19 and along axis B between:

an open configuration (not shown), in which it allows the fluidic connection between openings 20, 21, thus allowing the filling of container 2 with the food product; and a closed configuration (shown in FIG. 1), in which it prevents the fluidic connection between opening 20 and opening 21.

Gripping device 17 is movable together and synchronously with filling device 10 and carousel 3 about axis A.

Furthermore, gripping device 17 is movable parallel to axis B between:

a lowered rest position (not-shown); and a raised operative position (shown in FIG. 1), in which container 2 undergoes a filling operation.

In the embodiment shown, when gripping device 17 is in the raised operative position:

mouth 11 of container 2 is in contact with opening 21 of filling unit 10, in case of contact filling with a carbonated product; or mouth 11 of container 2 is spaced along axis B from opening 21 of filling unit 10, in case of contactless filing with a still product.

Still more precisely, gripping device 17 moves from the lowered rest position to the raised operative position at station I and moves from the raised operative position to the lowered rest position at station O.

Gripping device 17 comprises, in turn:

a frame 29; and a pair of jaws 30, 31 which are hinged about an axis C parallel to axis B to frame 29.

Jaws 30, 31 can me moved between:

a rest configuration in which they are free from neck 12 of container 2; and a gripping configuration in which they grip neck 12 of container 2.

In particular, jaws 30, 31 move from the open configuration to the closed configuration at station I, remain in the closed configuration from station I to station O, and move from the closed configuration to the open configuration at station O.

Unit 1 also comprises:

a stationary cam (not-shown) for moving gripping device 17 from the raised position to the lowered position; and a connecting element 50, which comprises a cam follower 48 rotatable about an axis E, cooperating with the cam, and operatively connected to gripping device 17.

Gripping device 17 and container 2 are arranged in aseptic area 7.

Connecting element 50 substantially comprises (FIGS. 1 to 4):

a pair of rods 52 which extends along respective axes D, are operatively connected to cam follower 48, and are operatively connected to gripping device 17;

a pair of housings 54 which surround respective rods 52 and through which rods 52 may slide parallel to respective axes D; and a pair of bellows 53.

Furthermore, connecting element 50 comprises an actuator 51, which exerts an action on the rods 52 parallel to axes D and directed towards cam follower 48 against the action of cam.

In particular, the action exerted by actuator 51 is upwardly directed in the embodiment shown.

Actuator 51 is arranged in non-aseptic area 6 and bellows 53 are arranged in aseptic area 7.

Actuator 51 is, in the embodiment shown, a pneumatic actuator and behaves as a pneumatic spring which acts against the action of cam on cam follower 48.

Housings 54 are stationary with respect to relative axes D, are shaped as hollow cylinder and slidably house relative rods 52.

Furthermore, housings 54 are arranged in part in non aseptic area 6 and in part in aseptic area 7.

Each rod 52 comprises:

an end 55 housed in non aseptic area 6 and on the side of cam follower 48;

an end 56, opposite to end 55, and arranged in aseptic area 7 on the side of respective bellow 53; and a portion 57 adjacent to end 56 and which moves from non-aseptic area 6 to aseptic area 7.

End 55 is fitted to a shaft 49, which extends along an axis E and rotates about axis E integrally with cam follower 48.

Axis E is, in the embodiment shown, orthogonal to axes A, B, C, D and horizontal.

Under the action of cam, rods 52 are movable between:

an uppermost position (shown in FIG. 1); and a lowermost position (not-shown).

Plate 60 and columns 61 connect rods 52 with gripping device 17.

Accordingly, when rods 52 are arranged in the uppermost position, gripping device 17 is in the operative raised position and bellows 53 assume their minimum length (FIG. 1).

When rods 52 are arranged in the lowermost position, gripping device 17 is in the rest lowered position and bellows 53 assume their maximum length.

Figure 2:
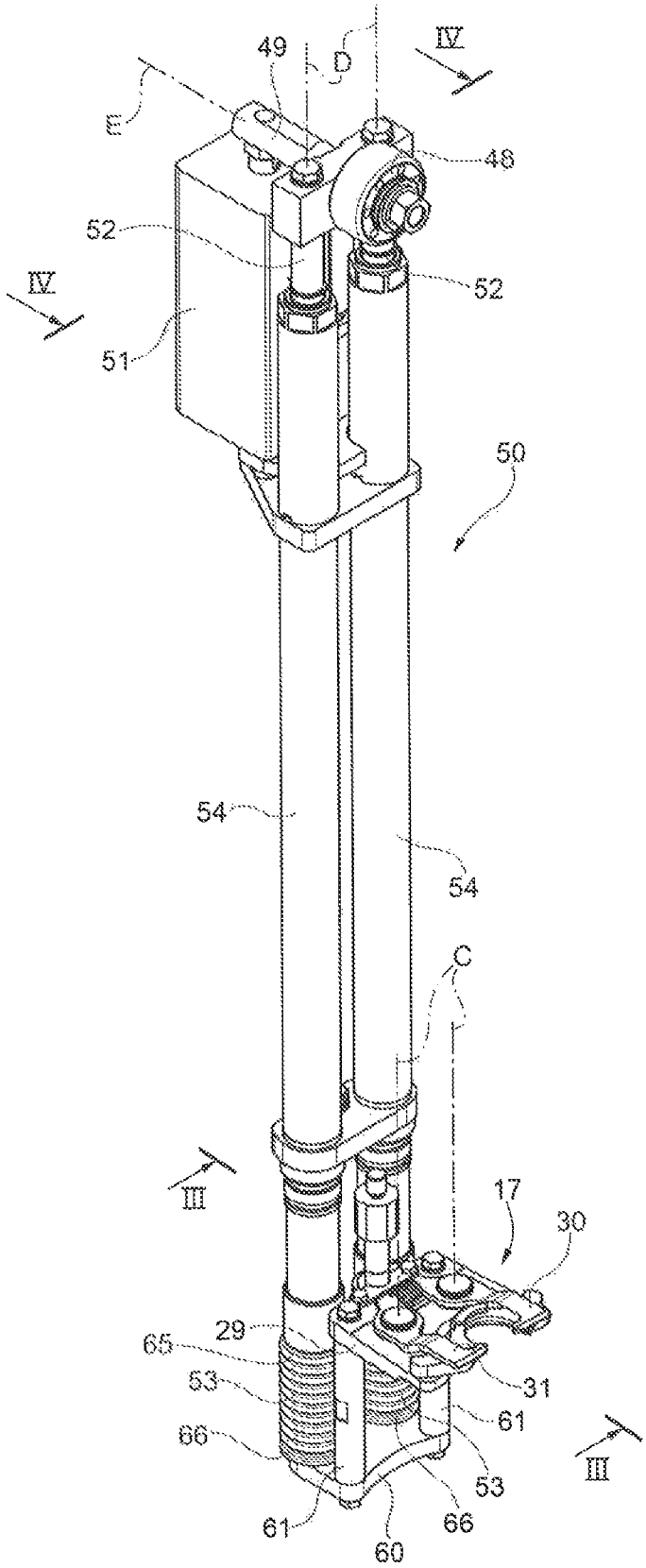
FIG. 2 is a perspective view of some components of the filling unit of FIG. 1 in an enlarged scale.
Figure 3:
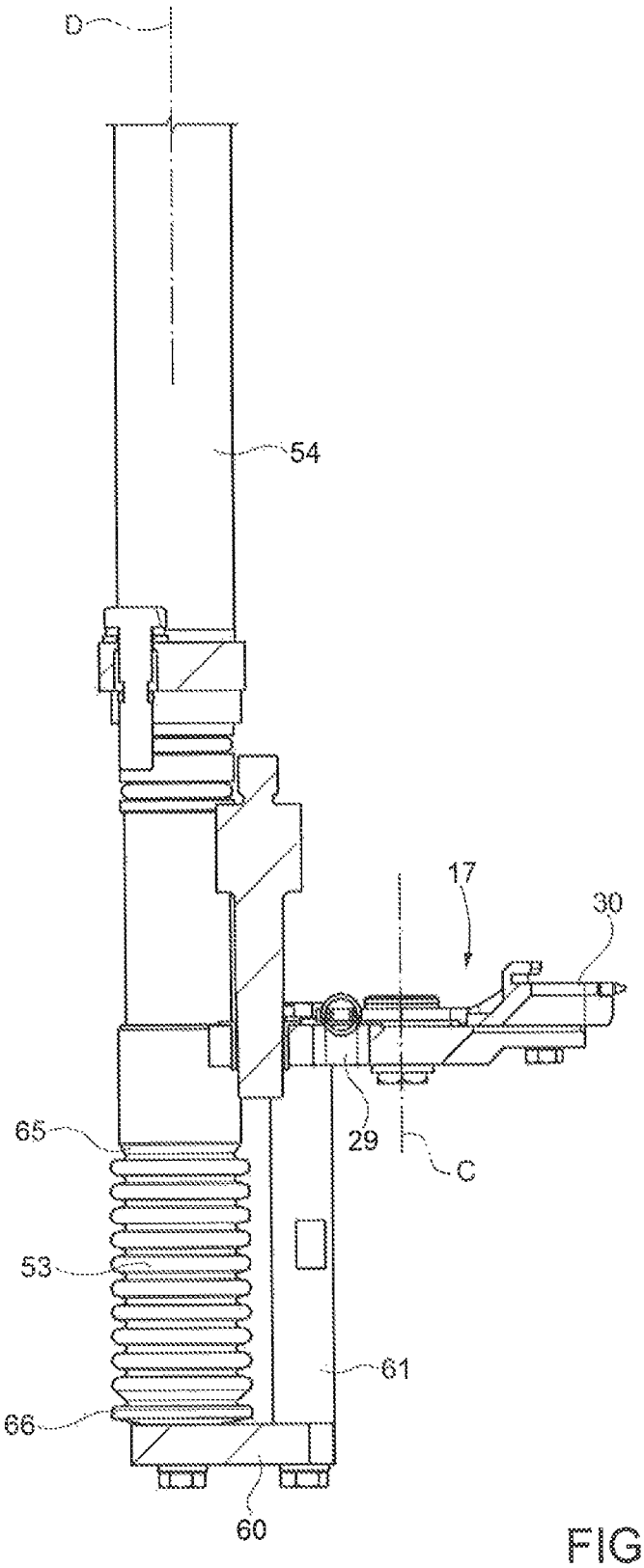
FIG. 3 is a section taken along line III-III of FIG. 2, with parts removed for clarity.

Advantageously, bellows 53 are arranged on the opposite side of gripping device 17 with respect to opening 21 of filling device 10 (FIG. 2).

In this way, bellows 53 prevent portions 57 of rods 52 from conveying non-sterile air from non sterile area 6 to sterile area 7.

Bellows 53 are arranged below gripping device 17 and below mouth 11 of container 2.

In particular, connecting element 50 comprises:

a plate 60 lying on plane orthogonal to axes D; and a pair of columns 61, which extend between plate 60 and frame 29 of gripping device 17.

In detail, columns 61 extend parallel to axes C.

Each bellow 53 comprises:

an end 65 fixed to housing 54 of respective rod 52; and an end 66, opposite to end 65 and fixed to plate 60.

Figure 4:
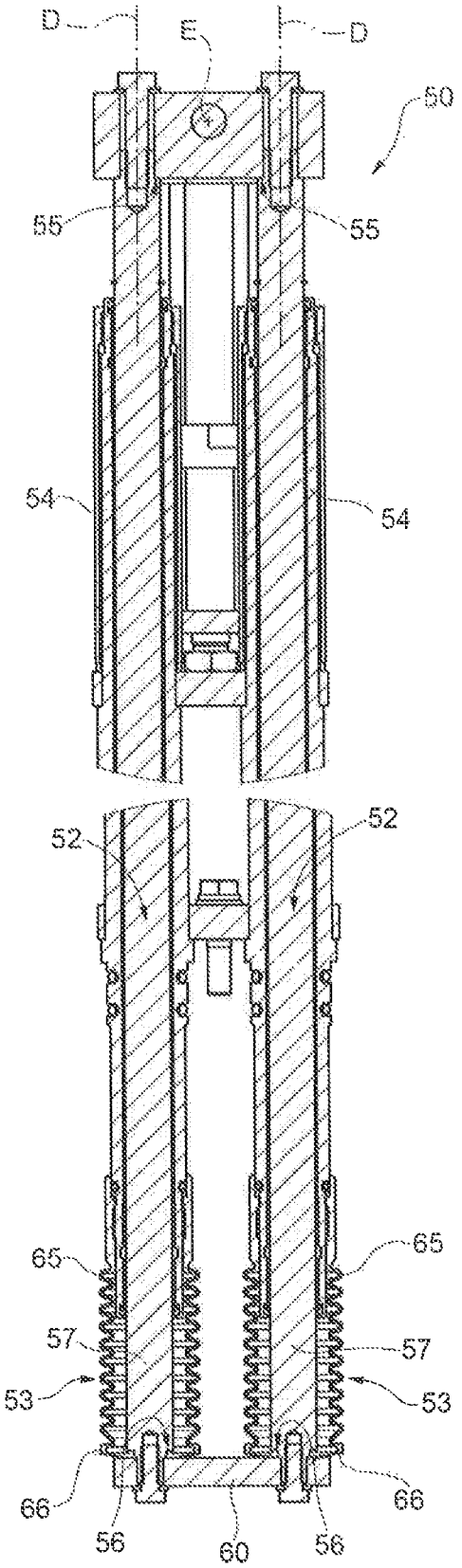
FIG. 4 is a section along line IV-IV of FIG. 2.
Figure 5:
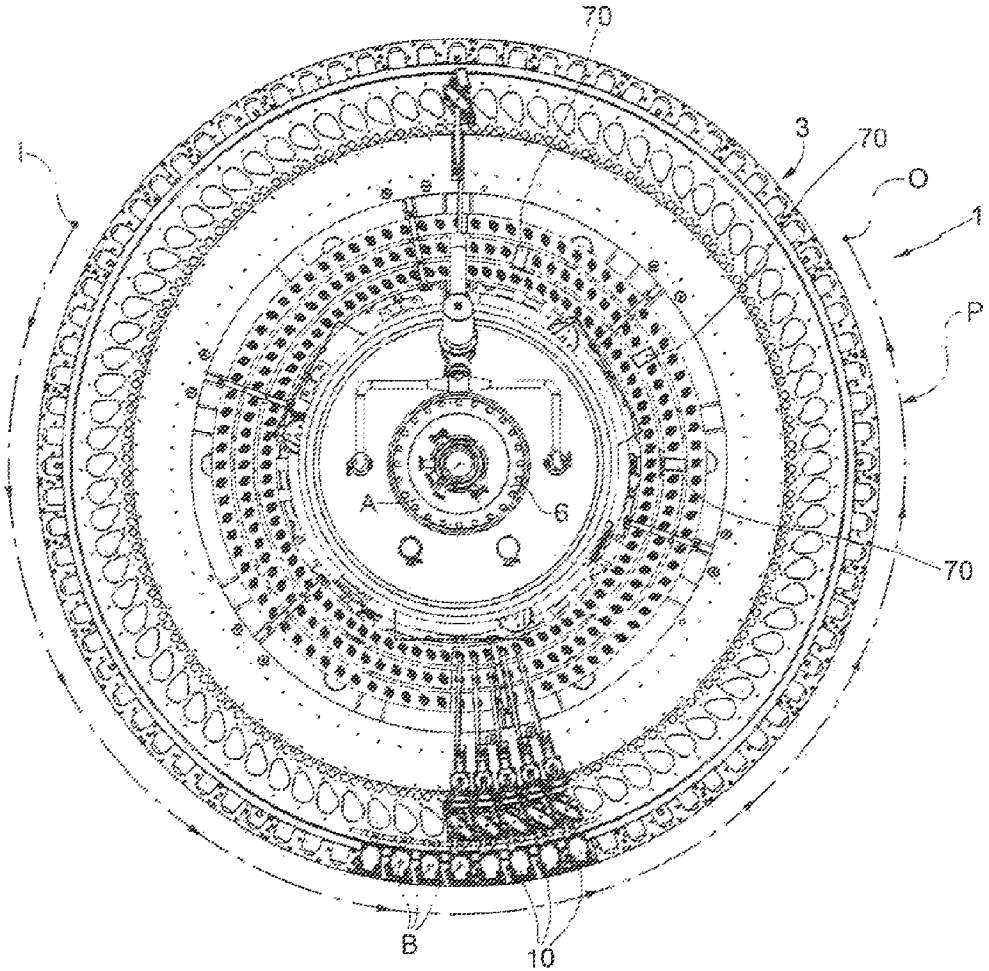
FIG. 5 is a top view of the filling unit of FIG. 1.

End 66 is furthermore sandwiched between end 56 of respective rod 52 and plate 60, as shown in FIG. 4.

End 65 is, in the embodiment shown, arranged above end 66.

Unit 1 also comprises:

ventilating means 70 (shown in FIGS. 1 and 5) adapted to create an airflow directed from non aseptic area 6 to aseptic area 7; and filtering means (not-shown) to filter the airflow generated by ventilating means 70 upstream from non-aseptic area 7.

Ventilating means 70 are adapted to maintain the pressure in aseptic area 7 at a higher value than in non-aseptic area 6.

In greater detail, ventilating means 70 create an airflow, which is directed from gripping device 17 towards bellows 53.

That airflow tend to a laminar condition, in the embodiment shown.

In this way, the air that escapes from bellows 53 is directed on the opposite side of mouth 11 of container 2.

Ventilating means 70 comprise, in the embodiment shown, a plurality of fans.

The capping unit is housed inside aseptic area 7.

The operation of filling unit 1 and machine 5 will be now described with reference to only one container 2, only one gripping device 17 and only one connecting element 50.

In particular, container 2 is inside aseptic area 7, when it is conveyed inside unit 1, filled with pourable food product, conveyed to capping unit and capped.

Furthermore, bellows 53 and gripping device 17 are arranged in aseptic area 7.

On the contrary, cam follower 48 and actuator 51 are arranged in non aseptic area 6.

Ends 55 of rods 52 are arranged in non aseptic area 6, portions 57 of ends 55 moves between non aseptic area 6 and aseptic area 7, ends 56 of rods 52 are arranged in aseptic area 7.

Housings 54 are arranged in part inside non aseptic area 6 and in part inside aseptic area 7.

Ventilating means 70 creates an airflow current from non-aseptic area 6 towards aseptic area 7.

That airflow is filtered by filtering means upstream from aseptic area 7, so that the non-sterile component cannot reach aseptic area 7

Hydraulic barrier 9 prevents the flow of non sterilized substances from non aseptic area 6 towards aseptic area 7, at the interface between frame 4 and carousel 3.

Furthermore, the operation of filling unit 1 will be now described starting from a configuration in which connecting element 50 is arranged at station I of path P and in which shutter 16 is in the closed configuration.

At station I, the interaction between cam and cam follower 48 keeps rods 52 in the lowermost position and therefore gripping device 17 in the lowered rest position.

As carousel 3 advances along path P, rods 52 upwards slide inside housings 54 parallel to axis D. This is due both to the shape of cam which contacts cam follower 48 and to the upwards action exerted by actuator 51 on rods 52.

The upwards sliding of rods 52 causes an upward movement of plate 60, columns 61 and gripping device 17.

As a result, rods 52 reach the uppermost position and the length of bellows 53 parallel to axes D decreases up to the minimum value (FIG. 1).

As gripping device 17 reaches the operative raised position, shutter 16 is displaced in the open configuration and the pourable product can pass through opening 21 and fill container 2.

In particular, when gripping device 17 is in the operative raised position, mouth 11 is arranged at a certain distance along axis B from opening 21, in case of contactless filling with a still pourable product.

In case of contactless filling with a carbonated pourable product, mouth 11 is in tight-fluid contact with opening 21 when gripping device 17 is in the operative raised position.

When a given amount of pourable product has filled container 2, shutter 16 moves back in the closed position.

When connecting element 50 reaches station O, the interaction of cam with cam follower 48 downwards moves rods 52 along axes D, thus causing the movement of gripping device 17 in the lowered rest position.

The downwards sliding of rods 52 with respect to housing 54 causes a downwards movement of plate 60, columns 61 and gripping device 17.

As a result, rods 52 reach the lowermost position along axes D and the length of bellows 53 parallel to axes D increases up to the maximum value.

In this condition, filled container 2 is withdrawn from jaws 30, 31 by a not-shown conveyor, e.g. a star wheel and conveyed, in a not-shown way, to the capping unit.

During the movement of rods 52 along respective axes D, respective portions 57 move between non aseptic area 6 and aseptic area 7.

Bellows 53 prevents the non sterile air driven by portions 57 from escaping inside aseptic area 7.

In case of leakage of bellows 53, the leaked non sterile air is driven by airflow generated by ventilating means 70 on the opposite side of gripping device 17.

In this way, the risk of contaminating container 2 and/or the pourable product filled therein is dramatically reduced.

From an analysis of the features of unit 1 according to the present invention, the advantages it allows to obtain are apparent.

In particular, bellows 53 are arranged on the opposite side of gripping device 17 with respect to openings 21 of filling devices 10.

In this way, the non sterile air that leaks from bellows 53 is substantially prevented to reach mouth 11 of containers 2, when the latter are spaced from respective openings 21 along respective axes B.

Accordingly, the risk of contamination of containers 2 and/or the pourable product is dramatically reduced when compared with the known solutions discussed in the introductory part of the present description.

The level of asepticity of the pourable food product is correspondingly enhanced in comparison with the above-identified known solutions.

Furthermore, the airflow generated by ventilating means 70 contributes to direct the non sterile area leaked from bellows 53 on the opposite side of gripping device 17 and, therefore, of containers 2 along axes D.

Finally, it is apparent that modifications and variants not departing from the scope of protection of the claims may be made to unit 1 disclosed herein.

In particular, unit 1 could be adapted to apply a cap onto containers 2 filled with an aseptic product.

Unit 1 could also be adapted to carry out an operation onto containers 2 under non aseptic condition, especially to fill containers 2 with non aseptic products.

Furthermore, ventilators 70 can create respective non-laminar, i.e. turbulent, airflows.

Finally, in case of contact filling with pourable product containing carbonated substances, the vacuum could be created inside containers 2 and/or a pressurization step could be carried out onto containers 2 before the filling thereof and/or a depressurization step could be carried out onto containers 2 after the filling step thereof.

The invention claimed is:

1. A unit for carrying out an operation on a container fillable with a pourable product under aseptic conditions, the unit comprising:

a first area;

a second area;

at least one operative head adapted to carry out the operation;

at least one gripping device configured to grip the container and which is movable between:

a rest position, in which the gripping device receives or discharges the container; and an operative position, in which the gripping device sets the container in a position in which the container undergoes the operation;

a movable element, which is operatively connected to the gripping device for moving the gripping device between the rest position and the operative position, and which includes a portion movable between the first area and the second area;

a bellow, which is arranged inside the second area and houses the portion of the movable element in a fluid-tight manner; and a connecting element including:

the movable element, which moves along a first axis;

a housing, which slidably houses at least the portion of the movable element; and a plate, which is connected to both the movable element and the gripping device, wherein the bellow is interposed between the housing and the plate, wherein the movable element further includes a rod extending parallel to the first axis, and the plate lies in a plane transversal to the first axis, and wherein the connecting element further includes at least one column interposed between the gripping device and the plate, the column extending parallel to a second axis and at a distance from the rod.

2. The unit of claim 1, further comprising:

a cam;

a cam follower operatively connected to the movable element and interacting with the cam, so as to cause the movement of the gripping device between the rest position and the operative position; and an actuator operatively connected to the movable element and adapted to exert on the gripping device an action directed between the rest position and the operative position.

3. The unit of claim 1, wherein the connecting element comprises a pair of movable elements joined to the same plate.

4. The unit of claim 3, wherein the connecting element comprises only one actuator for both of the movable elements.

5. The unit of claim 1, wherein:

the second area houses the operative head; and the unit further comprises:

ventilating device configured to establish a flow, which is directed from the first area towards the second area.

6. The unit of claim 5, wherein the ventilating device is arranged in the first area and the flow is directed from the operative head towards the bellow.

7. The unit of claim 5, further comprising a hydraulic barrier configured to separate the first area from the second area.

8. The unit of claim 1, wherein the operative head is a capping head for applying a cap onto the container or a filling head for filling the container with the pourable product.

9. The unit of claim 1, wherein the first area is a non-aseptic area and the second area is an aseptic area.

10. The unit of claim 1, wherein the gripping device includes a pair of jaws for gripping a portion of the container, the portion of the container being arranged, in use, between a mouth of the container and a bottom wall of the container, and wherein the bellow is arranged, in use, below the mouth of the container.

11. The unit of claim 1, wherein the bellow has an end disposed between the moveable element and the plate.

12. The unit of claim 1, wherein the gripping device is movable parallel to the first axis between the rest position and the operative position.

13. A unit having a head for carrying out an operation on a container fillable with a pourable product under aseptic conditions, the unit comprising:

a non-aseptic area;

an aseptic area;

at least one gripping device configured to grip the container and which is movable between:

a rest position, in which the gripping device receives or discharges the container; and an operative position, in which the gripping device retains the container in a position in which the container undergoes the operation;

a movable element operatively connected to the gripping device for moving the gripping device between the rest position and the operative position, the movable element having a portion movable between the non-aseptic area and the aseptic area;

a housing, which slidably houses at least the portion of the movable element;

a plate connected to the movable element and the gripping device;

a bellow arranged inside the aseptic area, the bellow housing the portion of the movable element in a fluid-tight manner, wherein the bellow is interposed between the housing and the plate; and a connecting element interposed between the gripping device and the plate, the connecting element extending parallel to the moving element.

14. The unit of claim 13, wherein the connecting element includes a pair of the movable elements joined to the same plate.

15. The unit of claim 14, wherein the connecting element comprises only one actuator for both of the movable elements.

16. The unit of claim 13, further comprising a ventilating device configured to establish a flow, which is directed from the non-aseptic area towards the aseptic area.

17. The unit of claim 13, further comprising a hydraulic barrier configured to separate the non-aseptic area from the aseptic area.

18. The unit of claim 13, further comprising:

a cam; and a cam follower operatively connected to the movable element and interacting with the cam, so as to cause the movement of the gripping device from one to the other of the rest position and the operative position.

19. The unit of claim 13, further comprising:

an actuator operatively connected to the movable element and adapted to exert on the gripping device an action directed between the rest position and the operative position.

20. The unit of claim 13, wherein the gripping device is movable parallel to the first axis between the rest position and the operative position.

* * * * *